US005737796A

United States Patent [19]

Sendzimir et al.

[11] Patent Number: 5,737,796

[45] Date of Patent: Apr. 14, 1998

[54] ROLL TYPE STRIP WIPING SYSTEM

[75] Inventors: Michael G. Sendzimir, Woodbury; John W. Turley, Oxford, both of Conn.

[73] Assignee: T. Sendzimir, Inc., Waterbury, Conn.

[21] Appl. No.: 712,390

[22] Filed: Sep. 11, 1996

[51] Int. Cl.[6] ..... B21B 45/02

[52] U.S. Cl. ..... 15/308; 15/256.52; 15/302; 15/309.1

[58] Field of Search ..... 15/309.1, 308, 15/256.52, 302, 102

[56] References Cited

U.S. PATENT DOCUMENTS

| | | | |
|---|---|---|---|
| 2,234,153 | 3/1941 | Herbert | 15/309.1 X |
| 2,472,596 | 6/1949 | Kunz | 15/309.1 X |
| 2,953,952 | 9/1960 | Alexander | 15/256.52 X |
| 3,398,022 | 8/1968 | Maust | 15/308 X |
| 4,551,878 | 11/1985 | Turley et al. . | |
| 4,769,924 | 9/1988 | Hikota et al. . | |
| 5,081,587 | 1/1992 | Matsui et al. | 15/256.52 X |

*Primary Examiner*—Chris K. Moore
*Attorney, Agent, or Firm*—Frost & Jacobs

[57] ABSTRACT

A wiping system for removing liquids such as lubricant and coolant liquids from the surfaces of a metallic strip. The system comprises upper and lower wiper rolls for wiping the upper and lower surfaces of the strip. The wiper rolls each comprise a metal core and a porous resilient covering. At least one upper backup roll for said upper wiper roll and at least one lower backup roll for said lower wiper roll providing support for said wiper rolls; urging said wiper rolls against their respective strip surfaces resulting in the formation of a liquid bead on each surface of said strip at the entry end of the wiper roll nip; and engaging their respective wiper rolls at contact zones at the entry ends of which beads of oil squeezed from said porous wiper roll covers are formed. A suction assembly is provided for each bead to remove liquid therefrom. The upper and lower backup rolls may be replaced by substantially identical clusters each comprising two intermediate or backup rolls and three sets of caster bearings.

15 Claims, 3 Drawing Sheets

ROLL TYPE STRIP WIPING SYSTEM

TECHNICAL FIELD

The application relates to a roll-type system for wiping liquids from the surfaces of strip material, and more particularly to such a system wherein the wiping rolls have porous resilient coverings from which accumulated liquid can be squeezed by one or more back-up rolls for vacuum removal.

BACKGROUND ART

In the cold rolling of metals it is normally necessary to supply copious quantities of a liquid to provide lubrication and cooling for the rolls and the rolled strip. The energy of deformation of the rolled product appears as heat, which must be removed by the coolant in order to avoid excessive temperature of the strip and of the rolls. When rates of deformation are high, the rate of heat generation is high, and high coolant flow rates are necessary. For example, a Sendzimir mill rolling 50 inch wide stainless steel typically uses a coolant flow rate of around 1000 gallons per minute.

In general, the coolant medium is oil based, and typical types used are straight mineral oil, and water/oil emulsions, (usually containing about 5% to 12% oil) either based upon mineral oils, or upon vegetable oils such as palm oil. It is usual to incorporate chemical additives in the oil, such as extreme pressure (E.P.) additives to increase fill strength, anti-oxidants, anti-rust compounds (in case of water/oil emulsions), anti-foam compounds and the like.

Subsequent to the rolling process the strip is frequently transferred to a process for which it is necessary to have little or no coolant (or additives) remaining on its surface. For example, when coils are batch annealed, surface oil can cause "stickers" (where adjacent laps of the coil stick together) and "staining" (discoloration of strip surface due to impurities or additives in the coolant). In some cases the strip can be cleaned before being transferred to the next process, but even then, cleaning is an additional cost to the strip processing operation, and elimination or reduction of the requirement for cleaning is a very worthwhile objective. Furthermore, even coiling of strip with an oily surface is hazardous, particularly at light gauges, because "telescoping" of the coil can readily occur. "Telescoping" is a term of art used when adjacent laps of the coil slide over one another in an axial direction, causing the strip emerging from the rolling mill to be forced to the side, thus producing a mill wreck. Surface oil can also adversely affect the measurement accuracy of strip thickness measuring equipment.

For these reasons, it is usual to provide cold rolling mills with strip wipers, which have the function of wiping the oil from the surface of the strip as it emerges from the mill, usually before the strip reaches the strip thickness gauges.

U.S. Pat. No. 4,551,878 describes the various types of strip wipers that were in common use at the time of that patent's publication (1985). These types were (1) bar wipers, (2) air flow type wipers and (3) roll wipers. Roll wipers were commonly two roll wipers and three roll wipers, both types utilizing metal (usually steel or bronze) rolls.

Since 1985 a number of strip wipers have been installed around the world, usually of the two roll type, but in some cases of the three roll type, wherein the wiper rolls have consisted of a metal core with a covering of a porous resilient (i.e. sponge-like) material, which more readily conforms to the profile of the strip.

It is essential for the covering material to be porous—tests with polyurethane covering material of various degrees of hardness have been made, and it is found that a hydrodynamic oil film develops readily between this covering and the strip which is so free of friction that the wiper rolls (mounted in roll bearings) do not rotate as the strip is passing through, and thus not only do not wipe the strip very well, but can cause scratches if any metal chips embed themselves in the covering. Using a porous covering seems to prevent the formation of a hydrodynamic oil film, probably because as the hydrodynamic pressure starts to develop, it forces the oil into the covering.

Commercially available porous resilient materials are usually made from non-woven fabrics, such as those supplied by 3M Co. (3M Brand Mill Rolls, 3M Abrasives Division), and by Armstrong Koverkwik of Pittsburgh under the designation Toho "NON-TEX" roll coverings.

In general, strip wipers utilizing rolls covered with porous resilient materials have performed quite well, particularly when used for wiping water/oil emulsions from the strip. For wiping mineral oil (used as a coolant on many mills) the performance is not so good, probably because the surface tension of oils is much lower than that of water, and the effectiveness of the wiper rolls in removing liquid from the strip is at least partially dependant upon capillary action, which is governed strongly by surface tension.

In trying to improve the performance of such wipers, U.S. Pat. No. 4,769,924 teaches the use of a hollow tubular core which is provided with radial holes. A vacuum is provided within this core so that any liquid absorbed into the porous covering will be sucked into the core and so removed by the vacuum generating device.

Although such a technique may work in some situations, we believe that, in the presence of particular contaminants that are generated by the rolling process (such as small metallic particles) the porous roll covering will act as a very effective filter which will trap the contaminants as the oil flows from the outer surface of the covering to the core, and the filter will become clogged with such particles, thus making the vacuum ineffective.

It is therefore a primary object of the present invention to provide an improved roll type strip wiping system which overcomes the above-noted problems of prior art systems.

DISCLOSURE OF THE INVENTION

According to the present invention there is provided an improved wiping system using rolls consisting of a metal core with a porous resilient covering, the improvement consisting of the provision of at least one metal backing roll for each wiper roll, which provides the functions of supporting the wiper roll and of generating a pinch point for wringing any absorbed oil out of the porous roll covering, and of the provision of suction devices for removing oil which has accumulated on the strip ahead of the nip and at the entry to the pinch point. The backing roll provides the additional advantage of reduced deflection under load, because it can be made much larger than the metal core of the wiper rolls, and enables the wiper rolls themselves to be much smaller and therefore more efficient and less costly than would otherwise be the case.

DETAILED DESCRIPTION OF THE INVENTION

Figure 1:
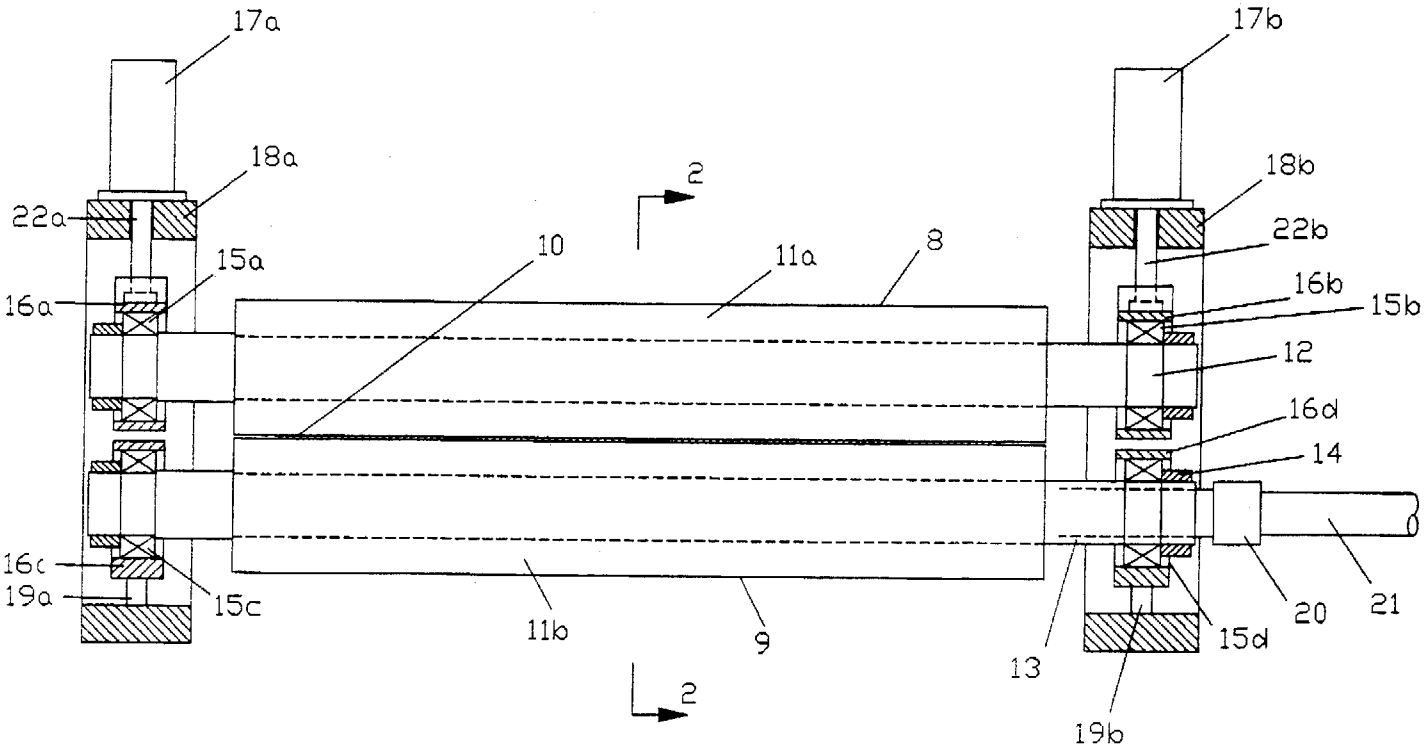
PRIOR ART FIG. 1
FIG. 1 is a fragmentary elevational view, partly in cross-section, of an exemplary prior art two-roll wiper assembly.
Figure 2:
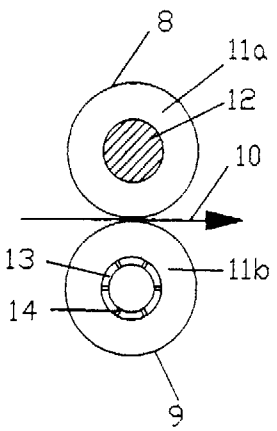
PRIOR ART FIG. 2
FIG. 2 is a simplified cross-sectional view taken along section line 2—2 of FIG. 1.

In FIGS. 1 and 2 a prior art two roll wiper system is shown. The prior art system comprises an upper wiper roll 8 and a lower wiper roll 9. The upper roll 8 consists of a porous resilient cover 11*a* mounted upon a core 12. The lower roll consists of a porous resilient cover 11*b* mounted on a core 13. The cores 12 and 13 of upper and lower rolls 8 and 9 can be either a solid core like core 12 of upper roll 8 or a hollow core like core 13 of lower roll 9. It will be noted that core 13 is provided with perforations 14 through which liquid can be drawn out of cover 11*b* by the application of vacuum, which is applied by means of rotary coupling 20 and pipe 21. It will be understood that FIGS. 1 and 2 are for illustrative purposes only. In practice, both the upper and lower wiper rolls 8 and 9 would have either a solid core 12 or a perforated hollow core 13, together with rotary union 20 and pipe 21 to connect each hollow core 13 to a vacuum source (not shown).

As can be seen in FIG. 1, cores 12 and 13 extend past the end of their respective roll covers 11*a* and 11*b* and are provided with bearings 15*a*–15*b* and 15*c*–15*d*. The bearings 15*a* and 15*b* of upper roll 8 are mounted within chocks 16*a* and 16*b*, respectively. Similarly, bearings 15*c* and 15*d* of lower roll 9 are mounted in chocks 16*c* and 16*d*, respectively. Chocks 16*a* and 16*c* are guidably mounted in frame-like housing 18*a*, while chocks 16*b* and 16*d* are guidably mounted in frame-like housing 18*b*. The lower chocks 16*c* and 16*d* of lower roll 9 are supported on blocks 19*a* and 19*b* within frame housings 18*a* and 18*b*, respectively. The upper chocks 16*a* and 16*b* of upper roll 8 are connected to piston rods 22*a* and 22*b* of cylinders 17*a* and 17*b*, respectively. The cylinders 17*a* and 17*b* are used to raise and lower the assembly of the upper wiper roll 8, its bearings 15*a* and 15*b* and its chocks 16*a* and 16*b*, in order to open and close the wiper system to allow threading of strip 10 between rolls 8 and 9. As this assembly is raised and lowered, it is guided by the chocks 16*a* and 16*b* sliding within the housings 18*a* and 18*b*, respectively.

In operation, the wiper rolls 8 and 9 are closed upon the strip 10 which passes through these rolls as it emerges from the rolling mill or other device which applies liquid to the strip. Cylinders 17*a* and 17*b* are required to apply sufficient force that the wiper rolls 8 and 9 are pressed firmly against the strip 10. In an exemplary situation, a force of about 100 pounds per inch of strip width may be applied. As a result, cores 12 and 13 bend, and it is necessary to grind a crown on the outside covers 11*a* and 11*b*. to achieve uniform pressure between wiper rolls 8 and 9 and strip 10 at every point across the width of the strip.

Because all points on the surface of covers 11*a* and 11*b* are driven by the strip 10 at the speed of the strip, the center portions of the covers, which, because of the crown are at a larger diameter than the end portions of the covers, tend to rotate at a smaller angular speed. This produces a twisting torque on each cover 11*a* and 11*b* and it is essential to key or bond the covers to their respective cores in order to transmit the twisting torque to the cores and thus prevent twisting of the covers, themselves.

Figure 3:
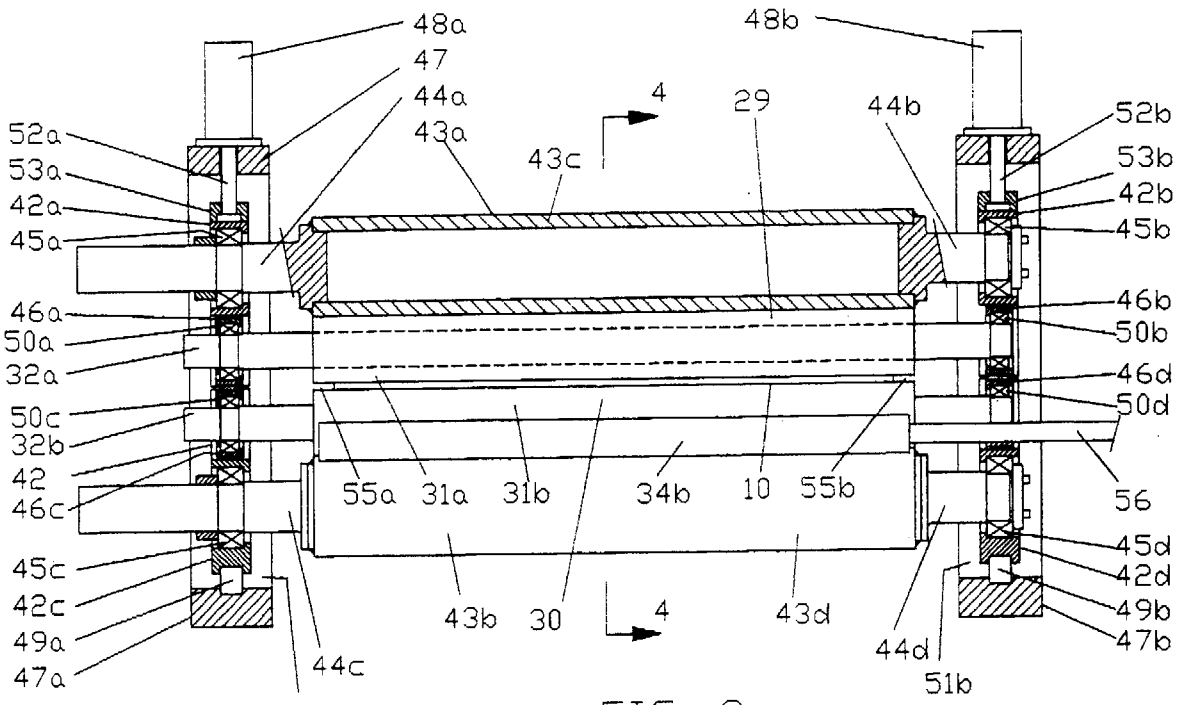
FIG. 3 is a fragmentary cross-sectional view, partly in cross-section, of one embodiment of the roll type strip wiping system of the present invention.
Figure 4:
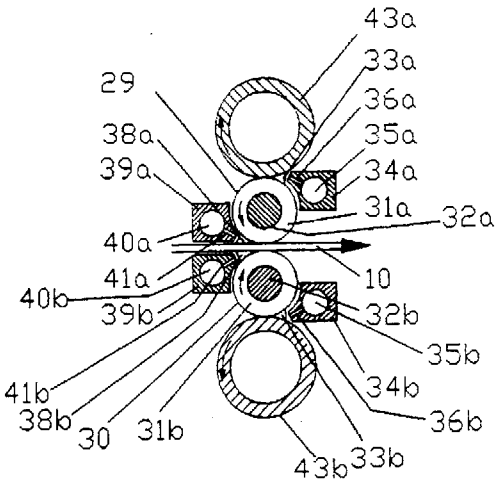
FIG. 4 is a simplified cross-sectional view taken along section line 4—4 of FIG. 3.
Figure 5:
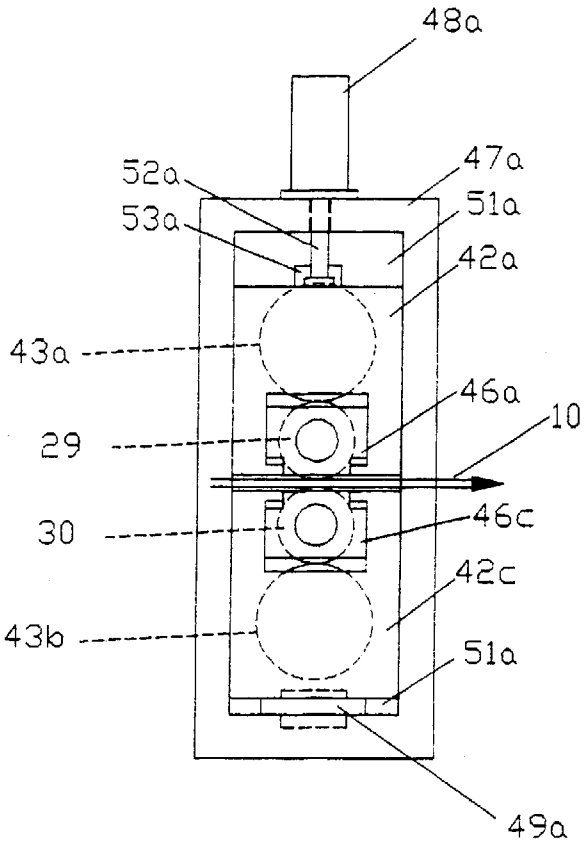
FIG. 5 is an end view of the structure of FIG. 3, as seen from the left of FIG. 3.

In FIGS. 3, 4 and 5, there is shown a two-roll wiper according to one embodiment of the present invention. In the arrangement of FIGS. 3–5, the wiper rolls 29 and 30 comprise metal cores 32*a* and 32*b* (which can be either solid or hollow, as described above) and porous resilient covers 31*a* and 31*b*. The cores 32*a* and 32*b* extend beyond the length of their respective covers 31*a* and 31*b*. Core 32*a* is provided with bearings 50*a* and 50*b* mounted in chocks 46*a* and 46*b*, respectively. The core 32*b* is provided with bearings 50*c* and 50*d* mounted in chocks 46*c* and 46*d*, respectively. Wiper rolls 29 and 30 are supported by back-up rolls 43*a* and 43*b*, respectively. Upper back-up roll 43*a* may comprise a hollow body 43*c* with stub shafts 44*a* and 44*b* welded to each end thereof. Similarly, lower back-up roll 43*b* may comprise a hollow body 43*d* to the ends of which stub shafts 44*c* and 44*d* are welded. The stub shafts 44*a* and 44*b* of upper back-up roll 43*a* are mounted by means of anti-friction (ball or roller) bearings 45*a* and 45*b* within upper back-up roll chocks 42*a* and 42*b*, respectively. Similarly, the stub shafts 44*c* and 44*d* of lower back-up roll 43*b* are mounted by means of anti-friction (ball or roll) bearings 45*c* and 45*d* within lower back-up roll chocks 42*c* and 42*d*, respectively. Upper and lower back-up roll chocks 42*a* and 42*c* are guidably mounted within frame-like housing 47*a*, in which they are free to slide up and down. Similarly, upper and lower back-up roll chocks 42*b* and 42*d* are guidably mounted within frame-like housing 47*b* in which they are also free to slide up and down. Chocks 42*c* and 42*d* for lower back-up roll 43*b* sit on spacers 49*a* and 49*b*, respectively at the bottom of the windows 51*a* and 51*b* defined by each housing 47*a* and 47*b*, respectively. These spacers are located in recesses in lower back-up roll chocks 42*c* and 42*d* and the housings 47*a* and 47*b* in order to locate the lower back-up roll 43*b* axially within the housings 47*a* and 47*b*. The chocks 42*a* and 42*b* of upper back-up roll 43*a* may be raised and lowered by hydraulic cylinders 48*a* and 48*b*, respectively. Cylinders 48*a* and 48*b* have piston rods 52*a* and 52*b*, respectively, which are attached to chocks 42*a* and 42*b* by retainers 53*a* and 53*b*. Cylinders 48*a* and 48*b* are mounted on housings 47*a* and 47*b*, respectively.

Wiper roll chocks 46*a*, 46*b*, 46*c* and 47*d* are slidably mounted in back-up roll chocks 42*a*, 42*b*, 42*c* and 42*d*, respectively. Since the back-up roll chocks 42*a*, 42*b*, 42*c* and 42*d* are constrained to move up and down only by their guidable mountings within housings 47*a* and 47*b*, the wiper roll chocks 46*a*, 46*b*, 46*c* and 46*d* are similarly constrained by their guiding within the back-up chocks, it will be understood that the wiper rolls 29 and 30 will be prevented from moving in a horizontal direction parallel to the direction of movement of the strip 10.

During operation of the wiper system of FIGS. 3, 4 and 5, the strip 10 passes between the wiper rolls 29 and 30, and is squeezed by the wiper rolls by the hydraulic cylinders 48*a* and 48*b* acting through back-up rolls 43*a* and 43*b*. A squeezing force of the order of 100 pounds per inch of strip width is applied. The incoming strip 10 has a coating of liquid on its upper and lower surfaces, and the squeezing action of the hydraulic cylinders 48*a* and 48*b* on the wiper rolls 29 and 30 causes the porous coverings 31*a* and 31*b* of the wiper rolls 29 and 30 to compress against the strip 10 and also against back-up rolls 43*a* and 43*b*.

This has two effects. First, the wiper rolls 29 and 30 act as a dam which prevents the liquid on the strip from passing through the nip. As a consequence, beads of liquid 38*a* and 38*b* build up on the top and bottom surfaces of strip 10 at the entry side of the nip (see FIG. 4). Secondly, any liquid which has soaked into the porous coverings 31*a* and 31*b* is squeezed out by the pressure of the respective back-up rolls 43*a* and 43*b* on coverings 31*a* and 31*b* of the wiper rolls, thus forming beads of liquid 33*a* and 33*b* at the entry side of the contact zones between back-up rolls 43*a* and 43*b* and coverings 31*a* and 31*b* of the wiper rolls, as shown in FIG. 4.

Suction headers 39*a* and 39*b* are used to remove liquid from beads 38*a* and 38*b*, respectively. The headers 39*a* and 39*b* extend across the full length of their respective wiper roll coverings 31*a* and 31*b* and the body portion of their respective back-up rolls 43*a* and 43*b*. The headers 39*a* and 39*b* include interior flow channels 40*a* and 40*b*, respectively, which are connected to an external vacuum source (not shown). A series of slots or holes 41 extend along the full length of header 39*a*, through which liquid from bead 38, together with some ambient air, is drawn by the action of the vacuum source into flow channel 40*a* and towards the vacuum source. It will be noted in FIG. 4 that header 39*b* is provided with a similar series of slots or holes 41*b*, serving the same purpose as slots or holes 41*a*.

In a similar fashion, suction headers 34*a* and 34*b* are used to remove liquid from beads 33*a* and 33*b*, respectively. Headers 34*a* and 34*b* extend across the full length of their respective wiper roll coverings 31*a* and 31*b* and the bodies of their respective back-up rolls 43*a* and 43*b*. The headers 34*a* and 34*b* are provided with flow channels 35*a* and 35*b* which are connected to an external vacuum source (not shown). As in the case of headers 39*a* and 39*b*, the headers 35*a* and 35*b* are provided with a series of slots or holes 36*a* and 36*b*, respectively, extending the full length of the headers and through which liquid from the bead 33*a* and 33*b*, together with some ambient air are drawn by the action of the vacuum source into flow channels 35*a* and 35*b*, respectively, and toward the vacuum source.

In FIG. 3, only the lower suction header 34*b* has been shown, for purposes of clarity. It can be seen that the header 34*b* extends across the full length of back-up roll body 43*d* and wiper roll covering 31*b*. A pipe 56 extends from one end of the header 34*b*, connecting flow channel 35*b* thereof to the external vacuum source (not shown).

It will be noted that gaps 55*a* and 55*b* exist between the upper and lower roll coverings 31*a* and 31*b* at each side of strip 10. One of the problems with prior art wiper rolls is that liquid passes through these gaps 55*a* and 55*b* and builds up on the outer surfaces of wiper roll coverings 31*a* and 31*b*. Eventually, this build up of liquid transfers to the edge of the strip 10 exiting the wiper system, forming a bead on each strip edge which is undesirable.

In the system of the present invention, the squeezing action of back-up rolls 43*a* and 43*b* against the coverings 31*a* and 31*b* of wiper rolls 29 and 30 prevents this surface liquid from passing through the contact zone between the back-up rolls and their respective wiper rolls, and causes the surface liquid to accumulate in beads 38*a* and 38*b* from which the liquid is extracted by the vacuum action of manifolds 39*a* and 39*b*, as described above. Thus, the build-up of liquid on the outer surface of wiper roll coverings 31*a* and 31*b* at each side of the strip is prevented, greatly improving wiping efficiency at the edges of strip 10.

Figure 6:
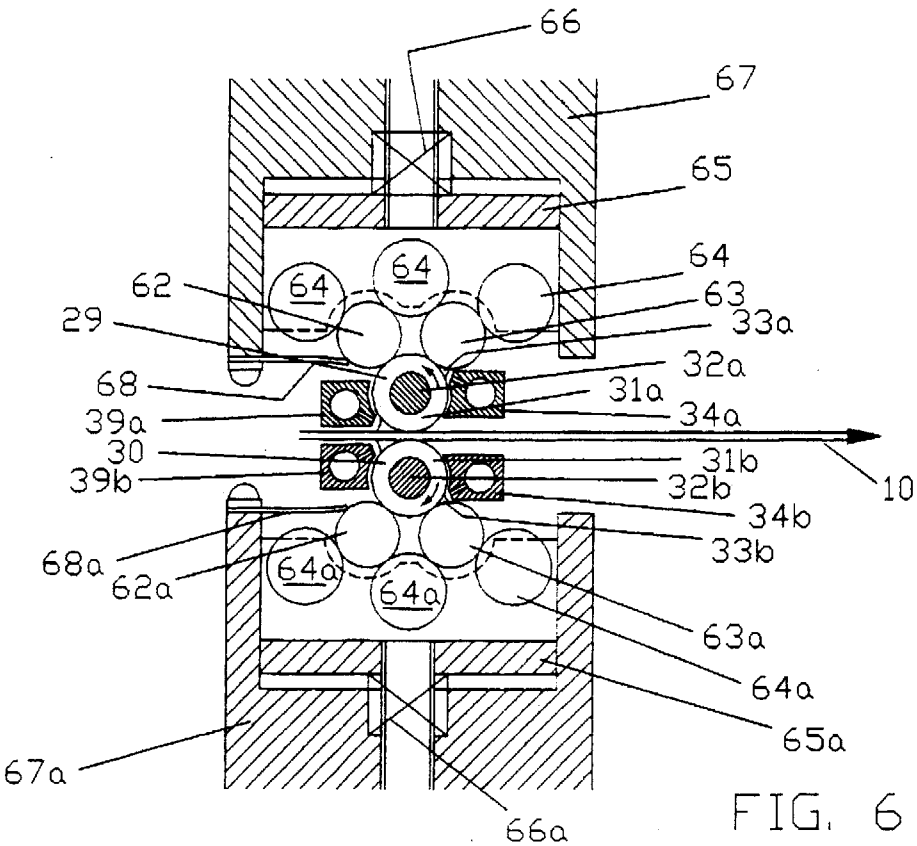
FIG. 6 is a simplified cross-sectional view of another embodiment of the roll type strip wiping system of the present invention.

Another embodiment of the present invention is shown in cross-section and in simplified form in FIG. 6. In this embodiment, the back-up rolls 43*a* and 43*b* are replaced by substantially identical upper and lower clusters. The upper cluster comprises intermediate rolls 62 and 63, and three sets of caster bearings 64 spaced at intervals across the width of the intermediate rolls 62 and 63, and mounted in a carrier 65. The carrier 65 is spring mounted via spring 66 to frame 67. Upper frame 67 can be raised and lowered relative to lower frame 67*a* by means of hydraulic cylinders (not shown) to provide a gap between the wiper rolls for threading the strip. Additional sealing is provided by elastomer seal 68 which prevents the liquid on the surface of strip 10, as it enters the wiper assembly, from splashing over the top of intermediate rolls 62 and 63, thus by-passing the wiper roll 29. These features are similar to those disclosed in commonly owned U.S. Pat. Nos. 4,551,878 and 4,843,673, the teachings of which are incorporated herein by reference. It will be understood that the lower cluster is substantially the same as the upper cluster and like parts have been given like index numerals followed by "a". Thus, the lower cluster comprises intermediate rolls 62*a* and 63*a* and three sets of caster bearings 64*a* spaced at intervals across the width of the intermediate rolls 62*a* and 63*a* and mounted in a carrier 65*a*. The carrier 65*a* is spring mounted to frame 67*a* via spring 66*a*. The lower cluster is provided with an elastomer seal 68*a* similar to the seal 68.

Because the porous resilient wiper roll covers 31*a* and 31*b* are too soft to be adequately supported by caster bearings spaced at intervals therealong, it is necessary to use hardened steel intermediate rolls 62, 63, 62*a* and 63*a* to support wiper rolls 29 and 30. It will be noted that intermediate rolls 62 and 63 are of the same length as the cover 31*a* of wiper roll 29 and intermediate rolls 62*a* and 63*a* are of the same length as the cover 41*b* of wiper roll 30. Because of this, the intermediate rolls provide continuous support for their respective wiper rolls. As indicated above, intermediate rolls 62 and 63 and intermediate rolls 62*a* and 63*a* are supported by their respective sets of caster bearings 64 and 64*a*. As a result of this, the wiper rolls 29 and 30 and the intermediate rolls 62, 63, 62*a* and 63*a* are fully supported in horizontal and vertical planes. Most importantly, this construction enables smaller (and therefore more efficient) wiper rolls to be used, than is the case with respect to the embodiment of FIGS. 3, 4 and 5.

In the embodiment of FIG. 6, manifolds 39*a* and 39*b* serve the same purpose as manifolds 39*a* and 39*b* of FIG. 4. Manifolds 34*a* and 34*b* remove beads 33*a* and 33*b*, respectively. The bead 33*a* is formed between wiper roll 29 and support roll 63. Similarly, manifold 34*b* removes the bead 33*b* formed between wiper roll 30*b* and support roll 63*a*. It should be noted that since there are two support rolls for each wiper roll, it is primarily the exit side support rolls 63 and 63*a* which provide the squeezing force which forces the liquid which has soaked into wiper roll coverings 31*a* and 31*b* to be squeezed out, thus forming beads 33*a* and 33*b* which are removed by suction manifolds 34*a* and 34*b*.

Modifications may be made in the invention without departing from the spirit of it.

What is claimed:

1. A roll assembly for wiping liquids from the upper and lower surfaces of a horizontally oriented metal strip, said roll assembly comprising a pair of upper and lower wiper rolls forming a nip therebetween and being mounted above and below said strip respectively with their axes parallel to the plane of the strip and extending transversely of said strip, said upper and lower wiper rolls each comprising a porous resilient covering on a metal core, said roll assembly further comprising at least one backup roll for each of said wiper rolls having a body length substantially equal to the length of said porous resilient covering of its respective wiper roll, said at least one backup roll of each wiper roll applying pressure to its respective wiper roll at the zone where they contact each other to urge its respective wiper roll against the adjacent surface of said strip, and to squeeze liquid absorbed by said porous cover of its respective wiper roll forming a bead of said squeezed liquid at the entry side of said contact zone between said backup roll and said wiper roll, and a suction assembly adjacent each such liquid bead for removal of liquid therefrom.

2. The roll assembly claimed in claim 1 including additional suction assemblies to remove liquid from beads thereof formed on said upper and lower surfaces of said strip at the entry side of said nip between said wiper rolls.

3. The roll assembly claimed in claim 2 wherein said liquid is lubricating and cooling liquid chosen from the class consisting of mineral oil and water/oil emulsions.

4. The roll assembly claimed in claim 2 wherein said upper and lower back up rolls each terminate in first and second shaft-like ends, first and second upper and lower chocks having anti-friction bearings are provided for said first and second ends of said upper and lower backup rolls respectively, the first upper and lower backup roll chocks are mounted in a first frame-like housing and are vertically movable therein, the second, upper and lower backup roll chocks are mounted in a second frame-like housings and are vertically movable therein, the first and second chocks for said lower backup roll normally rest on spacers within said first and second housings to properly locate said lower backup roll therein, said first and second chocks of said upper backup roll are each attached to the piston of a hydraulic cylinder, each cylinder being mounted on top of its respective housing whereby said upper backup roll can be raised and lowered within said housings by said cylinders, said cores of said upper and lower wiper rolls extending beyond their respective covers and providing first and second ends for said upper and lower wiper rolls, first and second upper and lower chocks having bearings are provided for said first and second ends of said upper and lower wiper rolls, said first and second chocks of said upper wiper roll being slidably mounted in said first and second chocks, respectively, of said upper backup roll, said first and second chocks of said lower wiper roll being slidably mounted in said first and second chocks, respectively, of said lower backup roll.

5. The roll assembly claimed in claim 4 wherein said strip is subjected to a squeezing force by said wiper rolls and said wiper roll covers are compressed against said strip and the adjacent backup roll by said hydraulic cylinders acting through said backup rolls.

6. The roll assembly claimed in claim 5 wherein said squeezing force is of the order of 100 pounds per inch of strip width.

7. The roll assembly claimed in claim 6 wherein said liquid is lubricating and cooling liquid chosen from the class consisting of mineral oil and water/oil emulsions.

8. The roll assembly claimed in claim 5, wherein said suction assemblies for said beads of liquid at said entry side of said contact zone between said upper wiper roll and said upper backup roll and said contact zone between said lower wiper roll and said lower backup roll, and said beads of liquid on the upper and lower surfaces of said strip at said entry side of said nip of said wiper rolls, comprise and elongated suction header for each bead, each suction header being of a length equal to the length of the adjacent wiper roll cover, a longitudinal interior flow channel being located in each suction header and being connected to a vacuum source, each suction header having a plurality of openings in a row along its full length through which liquid from the adjacent bead together with some ambient air is drawn into its flow channel and towards said vacuum source.

9. The roll assembly claimed in claim 2 wherein said suction assemblies for said beads of liquid at said entry side of said contact zone between said upper wiper roll and said upper backup roll and said contact zone between said lower wiper roll and said lower backup roll, and said beads of liquid on the upper and lower surfaces of said strip at said entry side of said nip of said wiper rolls, comprise an elongated suction header for each bead, each suction header being of a length equal to the length of the adjacent wiper roll cover, a longitudinal interior flow channel being located in each suction header and being connected to a vacuum source, each suction header having a plurality of openings in a row along its full length through which liquid from the adjacent bead together with some ambient air is drawn into its flow channel and towards said vacuum source.

10. The roll assembly claimed in claim 1 including two upper backup rolls for said upper wiper roll and two lower backup rolls for said lower wiper roll, said upper and lower backup rolls having bodies substantially equal in length to said porous, resilient covers of said upper and lower wiper rolls respectively, three sets of upper caster bearings for said upper backup rolls and spaced at intervals across the width of said upper backup rolls, three sets of lower caster bearings for said lower backup rolls and spaced at intervals across the width of said lower backup rolls, said upper and lower backup rolls applying pressure at the zones where they contact said upper and lower wiper rolls, respectively, to urge said upper and lower wiper rolls against said upper and lower strip surfaces, respectively, and to cause the forwardmost upper back up roll of the pair and the forwardmost lower backup roll of the pair to respectively squeeze liquid absorbed by said coverings of said upper and lower wiper rolls, said squeezed liquid forming beads at the entry end of said contact zones, and a suction assembly adjacent each such bead for removal of liquid therefrom.

11. The roll assembly claimed in claim 10 including additional suction assemblies to remove liquid from beads thereof formed on the upper and lower surfaces of said strip at the entry side of said nip between said wiper rolls.

12. The roll assembly claimed in claim 11 wherein said liquid is lubricating and cooling liquid chosen from the class consisting of mineral oil and water/oil emulsions.

13. The roll assembly claimed in claim 11 wherein said upper backing rolls and said upper three sets of caster bearings comprise an upper cluster and said lower backing rolls and said lower three sets of caster bearings comprise a lower cluster substantially identical to said upper cluster, said upper three sets of caster bearings being mounted in an upper carrier, said lower three sets of caster bearings being mounted in a lower carrier, said upper and lower carriers being spring biased toward said strip.

14. The roll assembly claimed in claim 11 wherein said suction assemblies for said beads of liquid at said entry side of said contact zone between said upper wiper roll and said forwardmost upper backup roll and said contact zone between said lower wiper roll and said forwardmost lower backup roll, and said beads of liquid on the upper and lower surfaces of said strip at said entry side of said nip of said wiper rolls, comprise an elongated suction header for each bead, each suction header being of a length equal to the length of the adjacent wiper roll cover, a longitudinal interior flow channel being located in each suction header and being connected to a vacuum source, each suction header having a plurality of openings in a row along its full length through which liquid from the adjacent bead together with some ambient air is drawn into its flow channel and towards said vacuum source.

15. The roll assembly claimed in claim 14 wherein said upper backing rolls and said upper three sets of caster bearings comprise an upper cluster and said lower backing rolls and said lower three sets of caster bearings comprise a lower cluster substantially identical to said upper cluster, said upper three sets of caster bearings being mounted in an upper carrier, said lower three sets of caster bearings being mounted in a lower carrier.

* * * * *

UNITED STATES PATENT AND TRADEMARK OFFICE

CERTIFICATE OF CORRECTION

PATENT NO. : 5,737,796

DATED : April 14, 1998

INVENTOR(S) : Michael G. Sendzimir & John W. Turley

It is certified that error appears in the above-indentified patent and that said Letters Patent is hereby corrected as shown below:

Column 6, line 46 (claim 1), please delete "Iower" and insert --lower--

Signed and Sealed this

Seventeenth Day of November, 1998

*Attest:*

Bruce Lehman

BRUCE LEHMAN

*Attesting Officer*

*Commissioner of Patents and Trademarks*